US011484475B2

(12) United States Patent
Chang

(10) Patent No.: US 11,484,475 B2
(45) Date of Patent: Nov. 1, 2022

(54) PILL DISPENSER

(71) Applicant: E-LINK PLASTIC & METAL INDUSTRIAL CO., LTD., New Taipei (TW)

(72) Inventor: Pin-Yang Chang, New Taipei (TW)

(73) Assignee: E-Link Plastic & Metal Industrial Co., Ltd., New Taipei (TW)

( * ) Notice: Subject to any disclaimer, the term of this patent is extended or adjusted under 35 U.S.C. 154(b) by 21 days.

(21) Appl. No.: 16/953,665

(22) Filed: Nov. 20, 2020

(65) Prior Publication Data

US 2022/0160584 A1 May 26, 2022

(51) Int. Cl.
*A61J 7/00* (2006.01)

(52) U.S. Cl.
CPC ..... *A61J 7/0076* (2013.01)

(58) Field of Classification Search
CPC ..... B65D 83/0463
See application file for complete search history.

(56) References Cited

U.S. PATENT DOCUMENTS 6,039,208 A * 3/2000 Lambelet, Jr. ..... B65D 83/0463 221/75
2004/0188313 A1* 9/2004 Tedham ..... B65D 83/0463 206/531
2017/0231871 A1* 8/2017 Aldasouqi ..... B65D 83/04 221/203

* cited by examiner

*Primary Examiner* — Gene O Crawford
*Assistant Examiner* — Ayodeji T Ojofeitimi
(74) *Attorney, Agent, or Firm* — Rosenberg, Klein & Lee

(57) ABSTRACT

A pill dispenser has a case, a pill storage plate, a turning assembly, and an operation assembly. The case has a dispensing hole formed on a bottom of the case. The pill storage plate is pivotally mounted in the case and has multiple pill chambers arranged around and adapted to sequentially align to and communicate with the dispensing hole when the pill storage plate is turned. The turning assembly is mounted in the case. The operation assembly has a pushing lever and an actuating unit. The pushing lever is pivotally mounted through the case. The actuating unit is located inside the case and fixed to the pushing lever. When the pushing lever pivots relative to the case, the actuating unit pushes the turning assembly and then the turning assembly turns the pill storage plate. By this, the pill dispenser is capable of dispensing pills immediately upon a simple and effort-saving operation.

19 Claims, 14 Drawing Sheets

PILL DISPENSER

BACKGROUND OF THE INVENTION

1. Field of the Invention

The present invention relates to a medical device, especially to a pill dispenser that dispenses pills immediately upon a simple and effort-saving operation.

2. Description of the Prior Arts

Conventionally, pills are stored in glass bottles with screw caps, and the bottles are usually stored in a drawer or a cabinet.

However, a bottle with a screw cap is difficult for a weak patient or an aged person to open since strong wrists and fingers are needed, and looking for the bottle in a drawer or a cabinet and then taking it out and opening it take a certain time.

Therefore, a device that dispenses pills immediately upon a simple operation is definitely needed.

To overcome the shortcomings, the present invention provides a pill dispenser to mitigate or obviate the aforementioned problems.

SUMMARY OF THE INVENTION

The main objective of the present invention is to provide a pill dispenser that dispenses pills immediately upon a simple and effort-saving operation.

The pill dispenser has a case, a pill storage plate, a turning assembly, and an operation assembly. The case has a dispensing hole formed on a bottom of the case. The pill storage plate is pivotally mounted in the case and has multiple pill chambers. The pill chambers are annularly arranged around a pivot between the pill storage plate and the case. Each one of the pill chambers is selectively aligned to and communicates with the dispensing hole during the pivoting of the pill storage plate. The turning assembly is mounted in the case and is capable of turning the pill storage plate. The operation assembly has a pushing lever and an actuating unit. The pushing lever is located outside of the case and is pivotally mounted in the case. The actuating unit is located inside the case and is fixed to the pushing lever. When the pushing lever pivots relative to the case, the actuating unit pushes the turning assembly and then the turning assembly turns the pill storage plate to make one of the pill chambers align to and communicate with the dispensing hole.

By the dispensing hole formed on a bottom of the case and the pill chambers selectively aligned to and communicating with the dispensing hole during the pivoting of the pill storage plate, a user is allowed to store pills in the pill chambers and retrieve the pills from the dispensing hole by turning the pill storage plate. With the pushing lever pivotally mounted through the case and the actuating unit located inside the case and fixed to the pushing lever, when the user turns the pushing lever, the actuating unit can push the turning assembly and then the turning assembly can turn the pill storage plate. Therefore, the user can retrieve the pills immediately by simply turning or pressing the pushing lever. Compared to a conventional bottle with a screw cap, turning or pressing the pushing lever is much easier than holding tightly to unscrew the screw cap for a patient since turning or pressing the pushing lever can be done by the whole arm while unscrewing the screw cap can only be done by fingers.

Therefore, the pill dispenser in accordance with the present invention works efficiently and saves time and effort.

Additionally, by specializing the number of the pill chambers to 7 or 30, the pill dispenser can be used for daily dispensing of pills in a week or a month.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
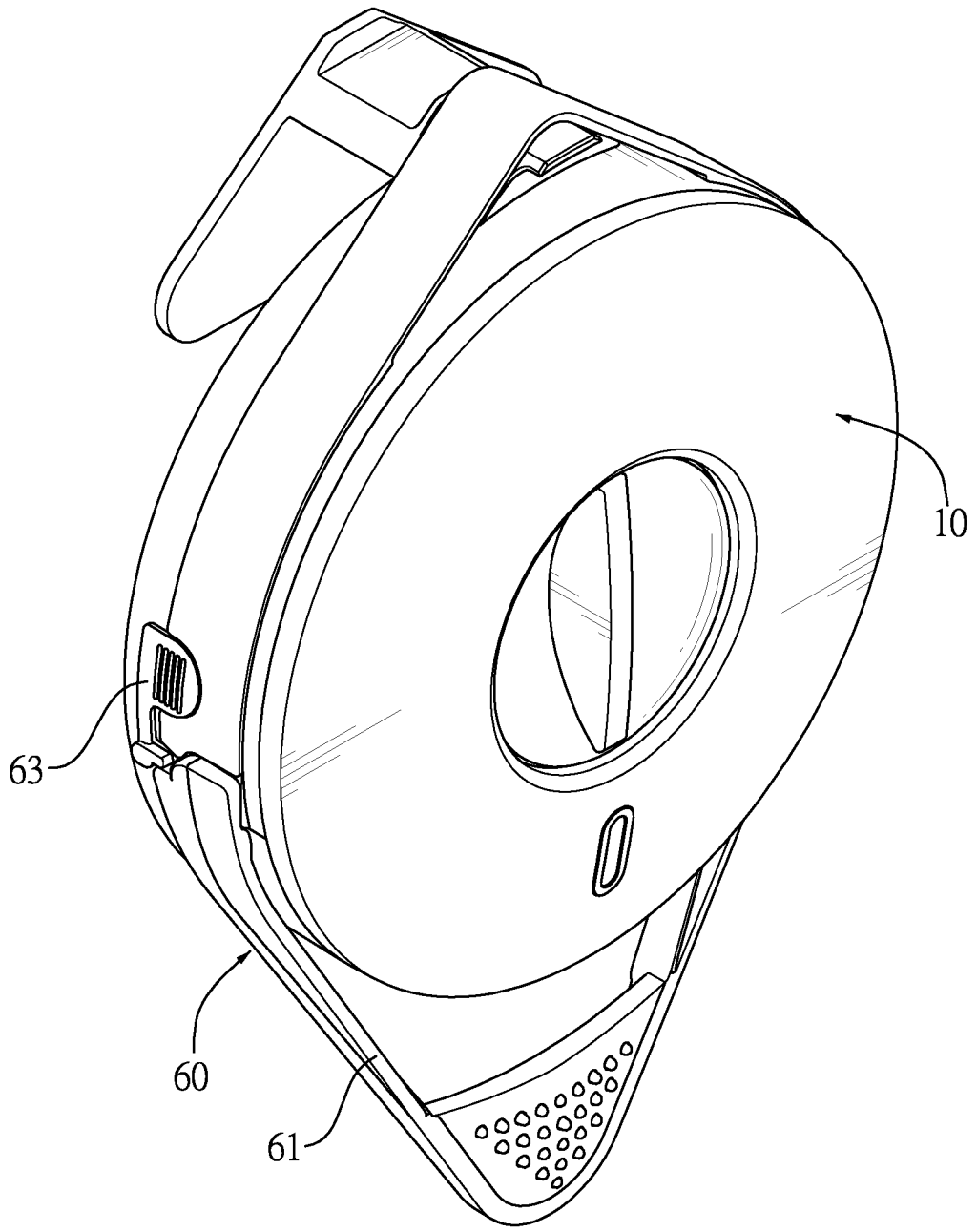
FIG. 1 is a perspective view of a first embodiment of a pill dispenser in accordance with the present invention.
Figure 2:
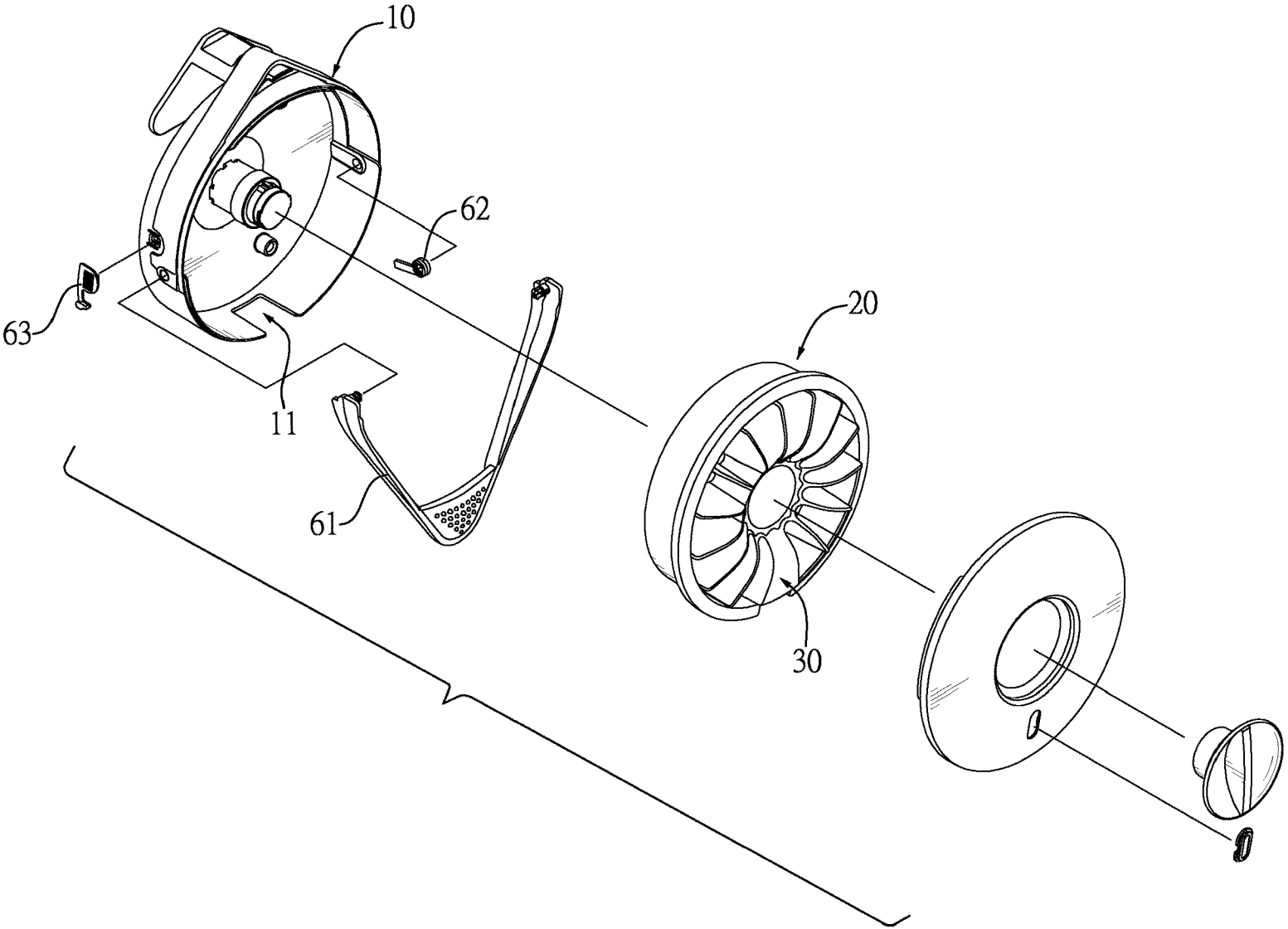
FIG. 2 is an exploded view of the first embodiment of the pill dispenser in FIG. 1, viewed from the front.
Figure 3:
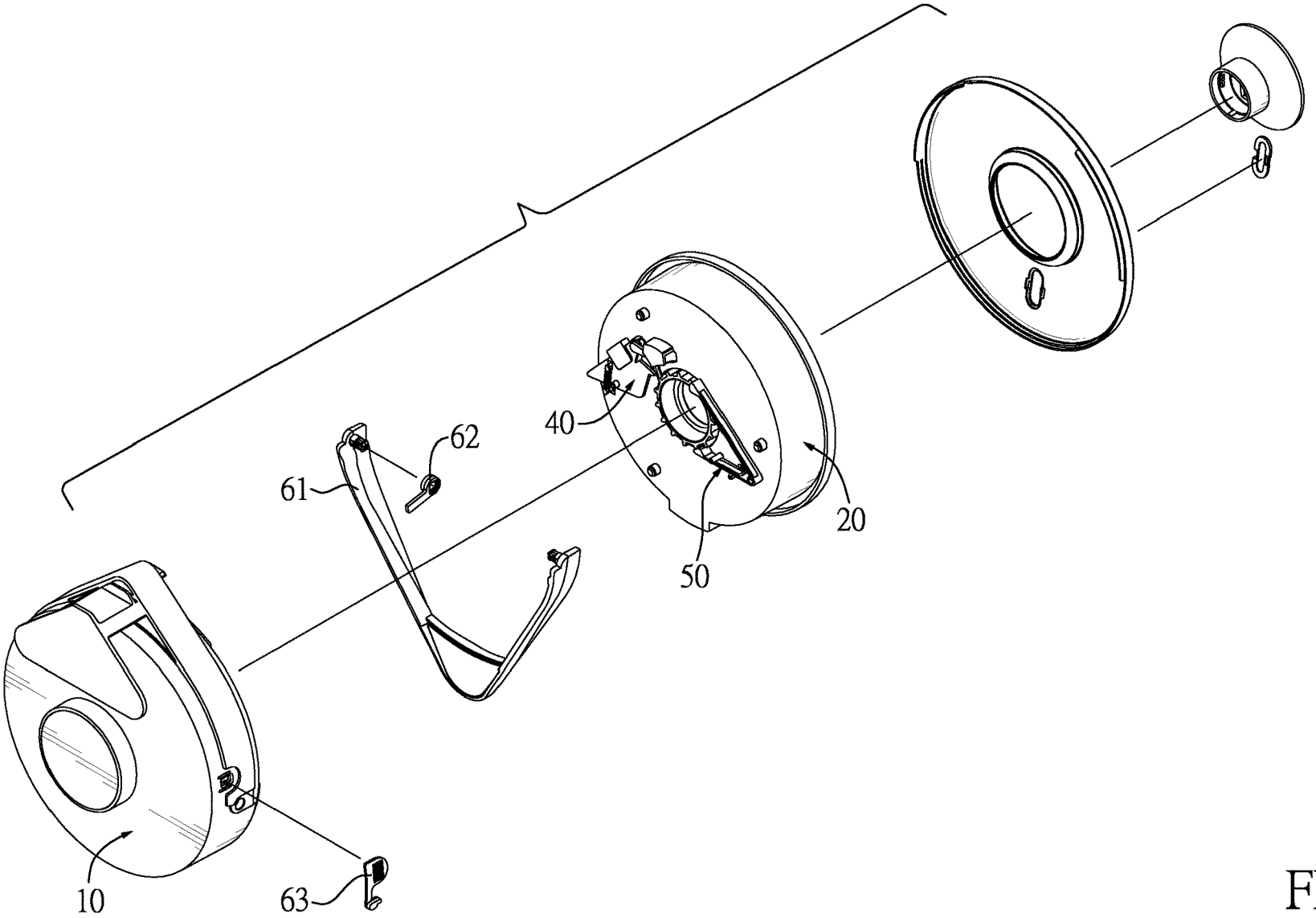
FIG. 3 is another exploded view of the first embodiment of the pill dispenser in FIG. 1, viewed from behind.

With reference to FIGS. 1, 2, and 3, in a first embodiment, a pill dispenser in accordance with the present invention comprises a case 10, a plate base 20, a pill storage plate 30, a turning assembly 40, a spring sheet 50, and an operation assembly 60.

The case 10 has a dispensing hole 11 formed on a bottom of the case 10.

Figure 4:
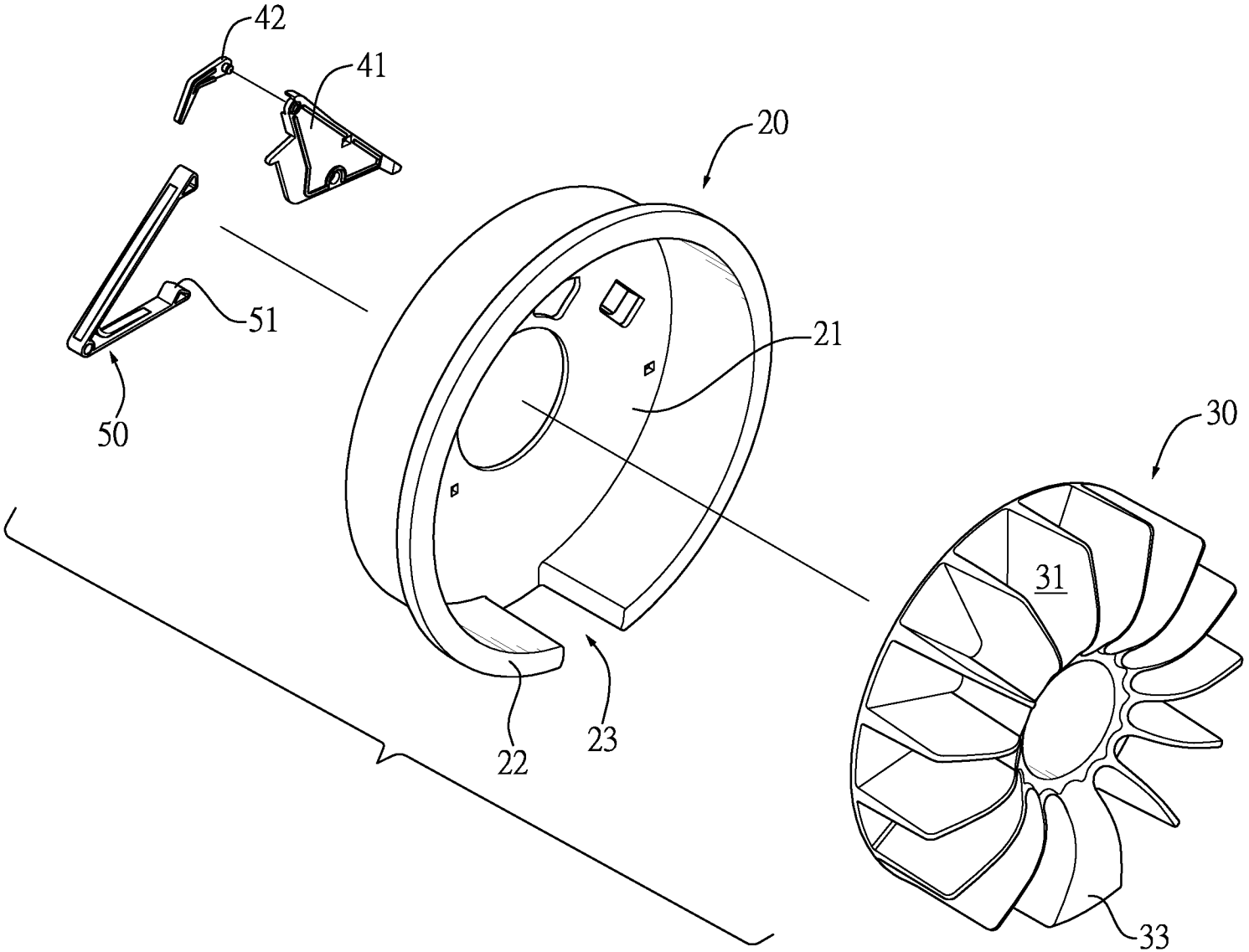
FIG. 4 is still another exploded view of the first embodiment of the pill dispenser in FIG. 1, showing the plate base, the pill storage plate, and the turning assembly, viewed from the front.
Figure 5:
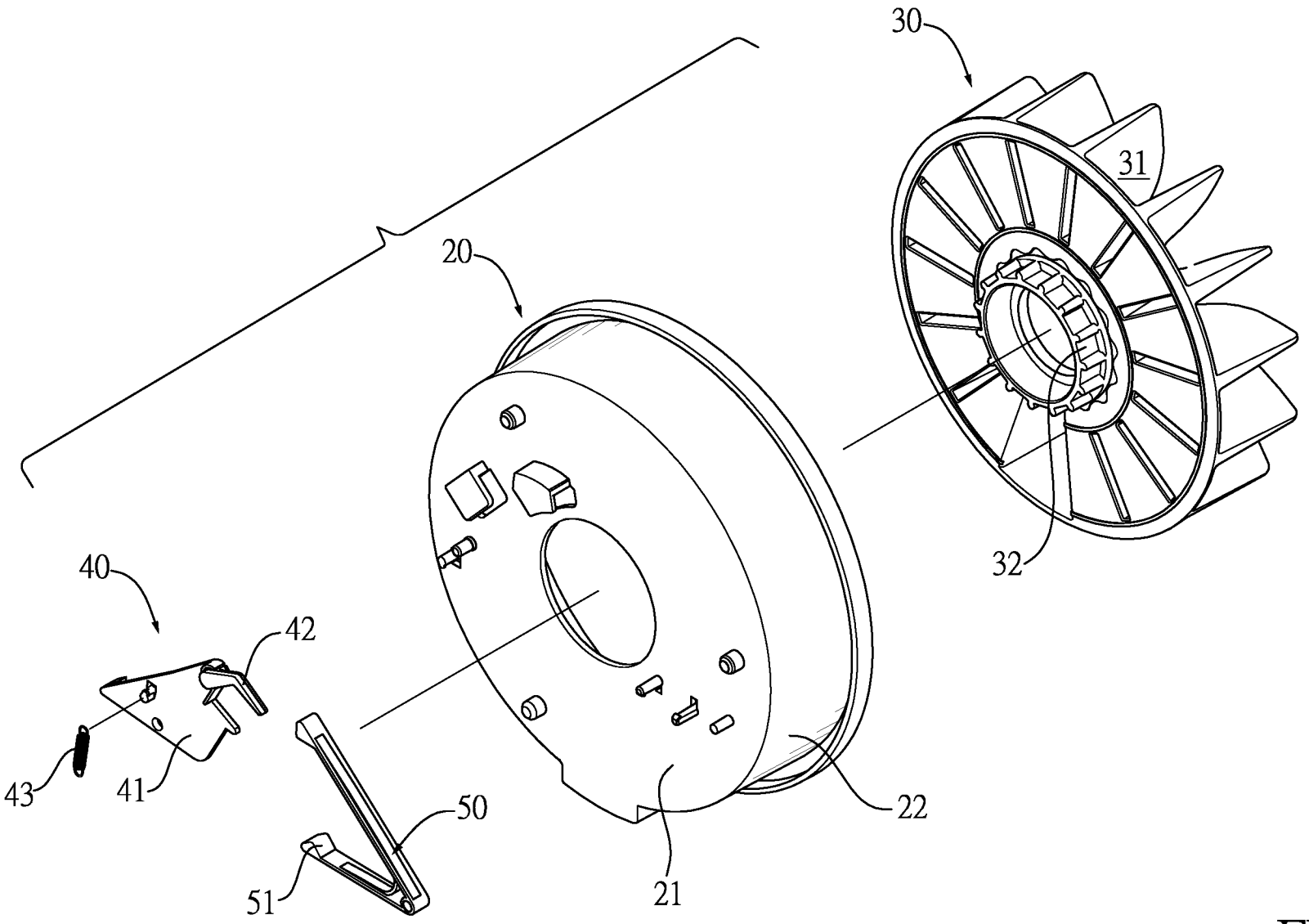
FIG. 5 is still another exploded view of the first embodiment of the pill dispenser in FIG. 1, showing the plate base, the pill storage plate, and the turning assembly, viewed from behind.

With further reference to FIGS. 4 and 5, the plate base 20 is mounted in the case 10 and has a base board 21 and a surrounding wall 22. The base board 21 has a connecting hole formed through a center of the base board 21. The surrounding wall 22 is formed on a periphery of the base board 21 and has a pill opening 23. The pill opening 23 is formed through the surrounding wall 22 and is aligned to the dispensing hole 11 of the case 10.

The pill storage plate 30 is pivotally mounted in an inner side of the surrounding wall 22 of the plate base 20. The pill storage plate 30 has multiple pill chambers 31, a gear segment 32, and a blocking segment 33. The pill chambers 31 are annularly arranged around a pivot between the pill storage plate 30 and the case 10. Each one of the pill chambers 31 is selectively aligned to and communicates with the dispensing hole 11 through the pill opening 23 of the plate base 20 during the pivoting of the pill storage plate 30. The gear segment 32 is rotatably mounted through the connecting hole of the plate base 20. The blocking segment 33 is formed between any two adjacent ones of the pill chambers 31 and is adapted to align to and block the pill opening 23 of the plate base 20.

Figure 8:
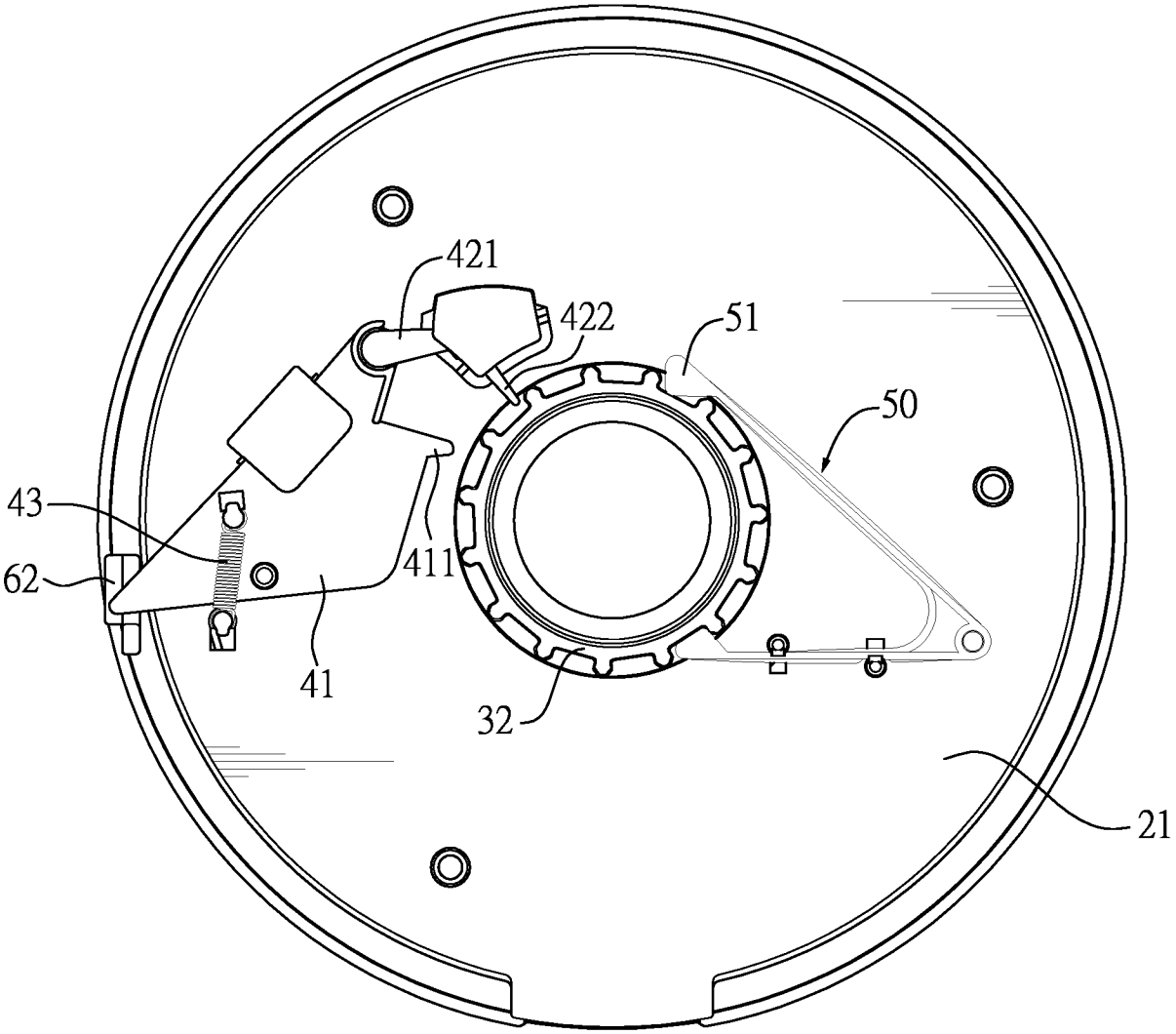
FIGS. 8 to 10 are back operational views of the first embodiment of the pill dispenser in FIG. 1, showing the pill storage plate, the turning assembly, and the spring sheet.
Figure 9:
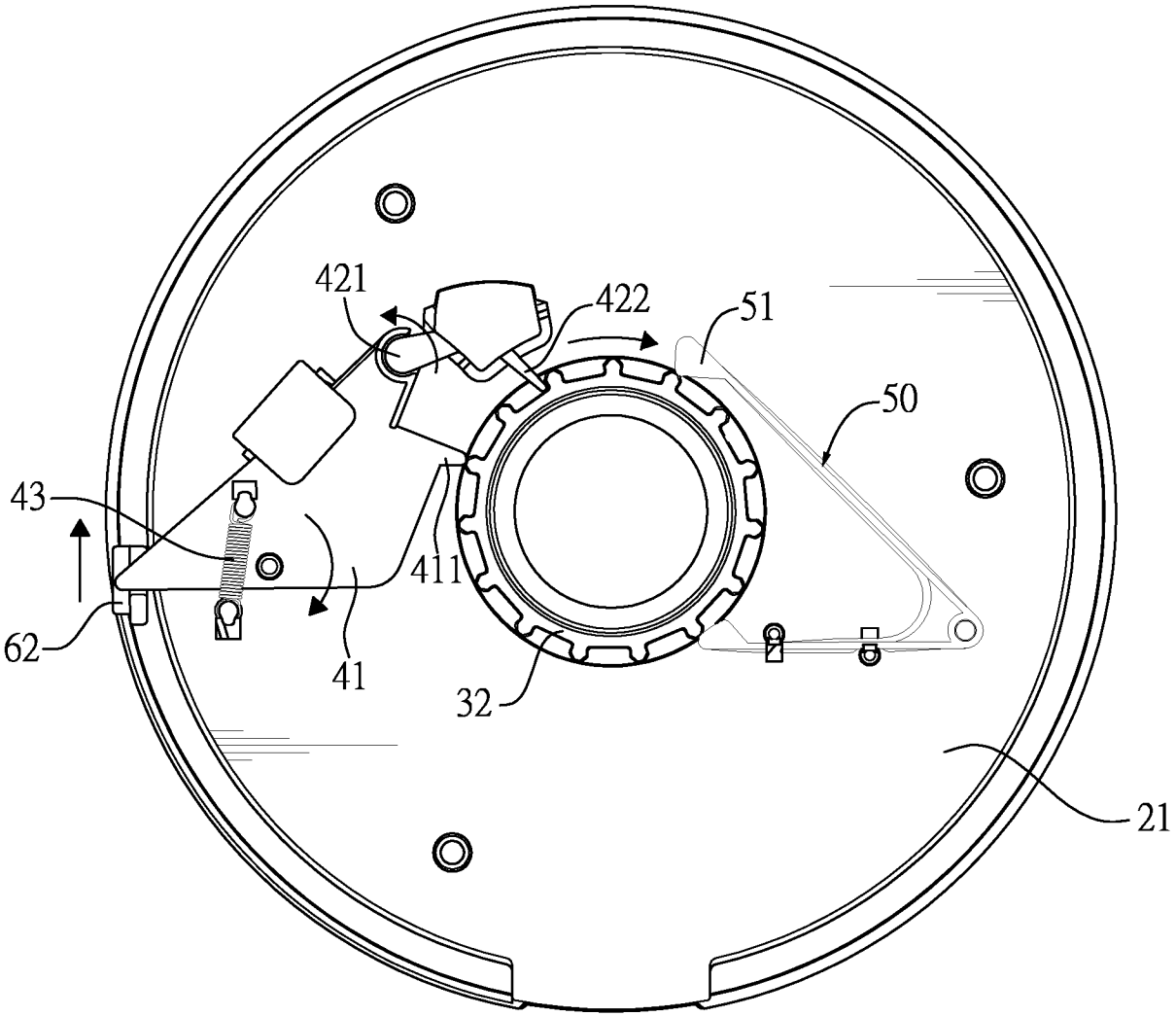
Figure 10:
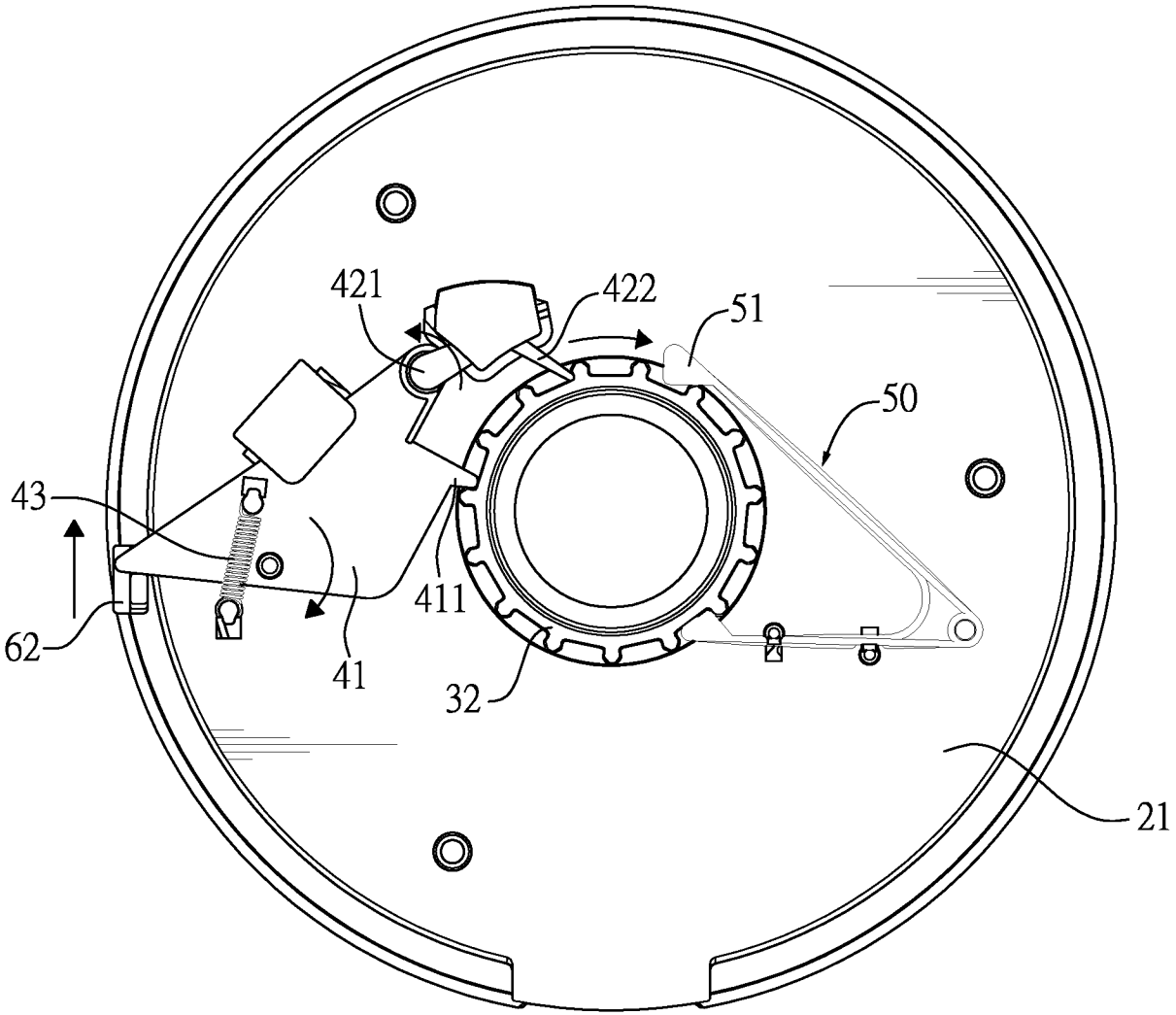

With further reference to FIGS. 3, 4, and 8, the turning assembly 40 is mounted in the case 10 and is capable of turning the pill storage plate 30. Specifically, in the first embodiment, the turning assembly 40 is mounted on the base board 21, is located on a side, which is opposite to the pill storage plate 30, of the base board 21, and selectively abuts the gear segment 32 of the pill storage plate 30 to turn the pill storage plate 30.

The turning assembly 40 has a first unit 41, a second unit 42, and an elastic unit 43. The first unit 41 is pivotally mounted on the base board 21 and has a stopping segment 411. The second unit 42 is pivotally mounted on the first unit 41 and has a connecting segment 421 and an abutting segment 422. The connecting segment 421 is in a strip shape and is pivotally mounted on the first unit 41. The abutting segment 422 is in a strip shape, is formed on an end, which is opposite to the first unit 41, of the connecting segment 421, and forms an angle with the connecting segment 421. The angle is larger than 90 degrees.

When the turning assembly 40 is pushed by the operation assembly 60, the first unit 41 is turned and the abutting segment 422 of the second unit 42 abuts the gear segment 32 of the pill storage plate 30, and then the connecting segment 421 of the second unit 42 pivots relative to the first unit 41, and the abutting segment 422 pushes one of gear teeth of the gear segment 32 to turn the pill storage plate 30. After the second unit 42 turns the pill storage plate 30, the stopping segment 411 of the first unit 41 abuts one of the gear teeth of the gear segment 32 of the pill storage plate 30 to stop the pill storage plate 30.

The elastic unit 43 is connected between the first unit 41 and the base board 21, and is configured to turn the first unit 41 to move the second unit 42 away from the gear segment 32 of the pill storage plate 30.

The structure of the turning assembly 40 is not limited to the abovementioned, as the turning assembly 40 can also be implemented as a single lever pivotally mounted in the case 10, without the first unit 41, the second unit 42, and the elastic unit 43.

The spring sheet 50 is mounted on the base board 21 of the plate base 20, is located on the side, which is opposite to the pill storage plate 30, of the base board 21, abuts the gear segment 32 of the pill storage plate 30, and positions the pill storage plate 30. Specifically, in the first embodiment, the spring sheet 50 is in a V shape and has two block segments 51 respectively formed on two ends of the V shape and engaging with the gear segment 32 of the pill storage plate 30. When the pill storage plate 30 is turned, the gear segment 32 of the pill storage plate 30 bends the spring sheet 50 and disengages from the two block segments 51 such that the gear segment 32 turns relative to the spring sheet 50.

Figure 11:
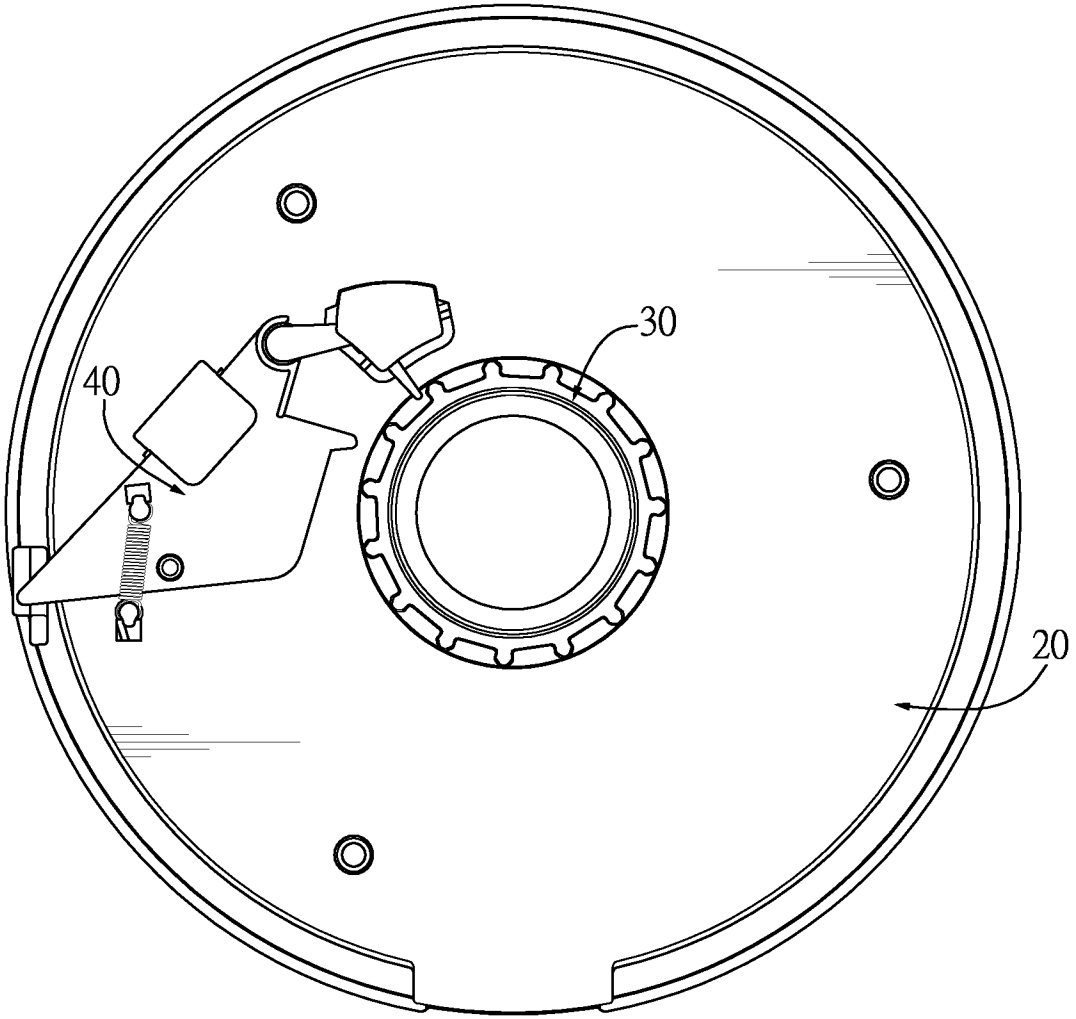
FIG. 11 is a back view of the first embodiment of the pill dispenser in FIG. 1, showing an embodiment without the spring sheet.

The spring sheet 50 can be implemented without the two block segments 51, such that the spring sheet 50 simply abuts, instead of engaging, one of the gear teeth of the gear segment 32, and the spring sheet 50 is also not limited to be in a V shape. Further, the spring sheet 50 is configured to position the pill storage plate 30, but the pill dispenser can also be implemented without the spring sheet 50. In such embodiment, with reference to FIG. 11, the pill storage plate 30 can be selectively fixed by any other component or the pill storage plate 30 can be always free to rotate.

Figure 6:
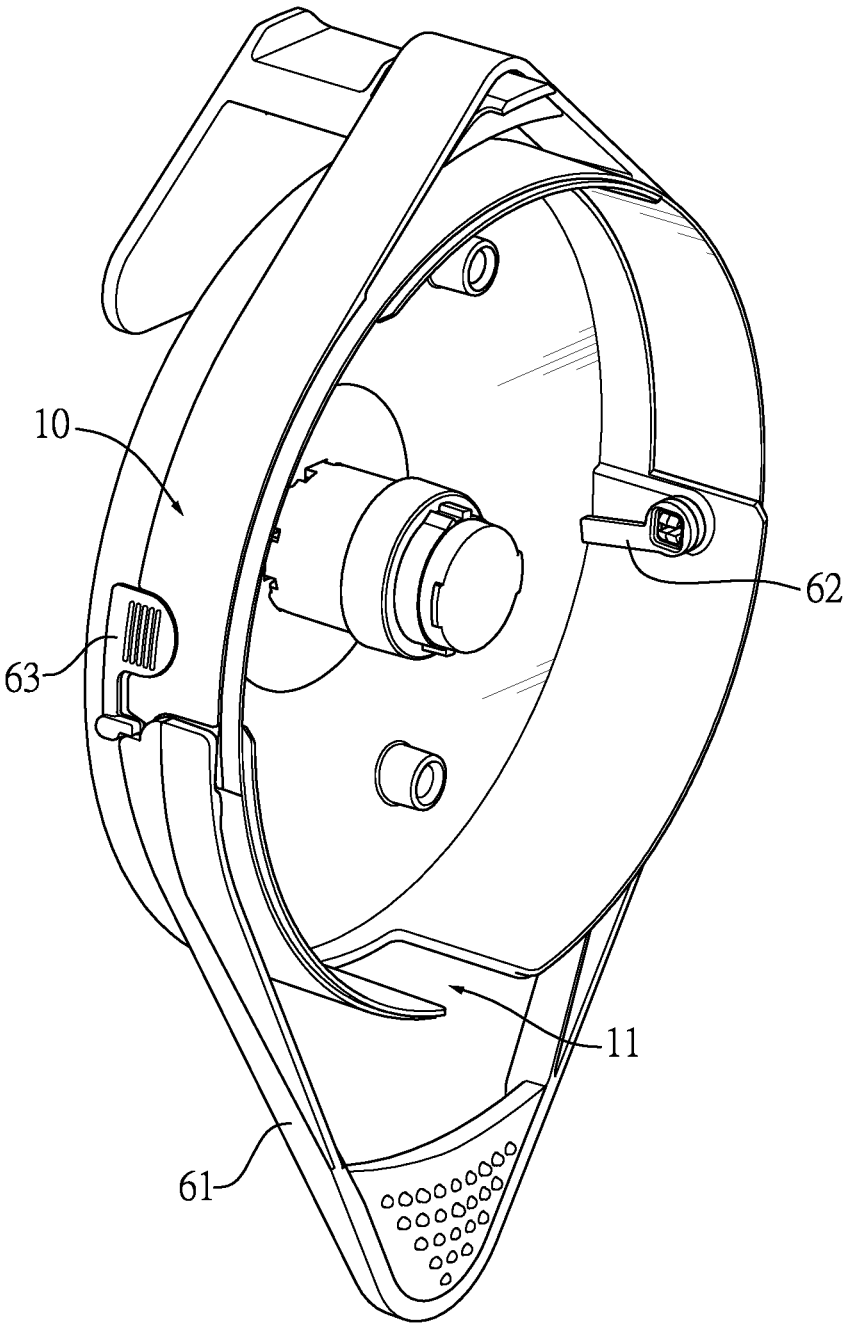
FIGS. 6 and 7 are perspective operational views of the first embodiment of the pill dispenser in FIG. 1, showing the operation assembly.
Figure 7:
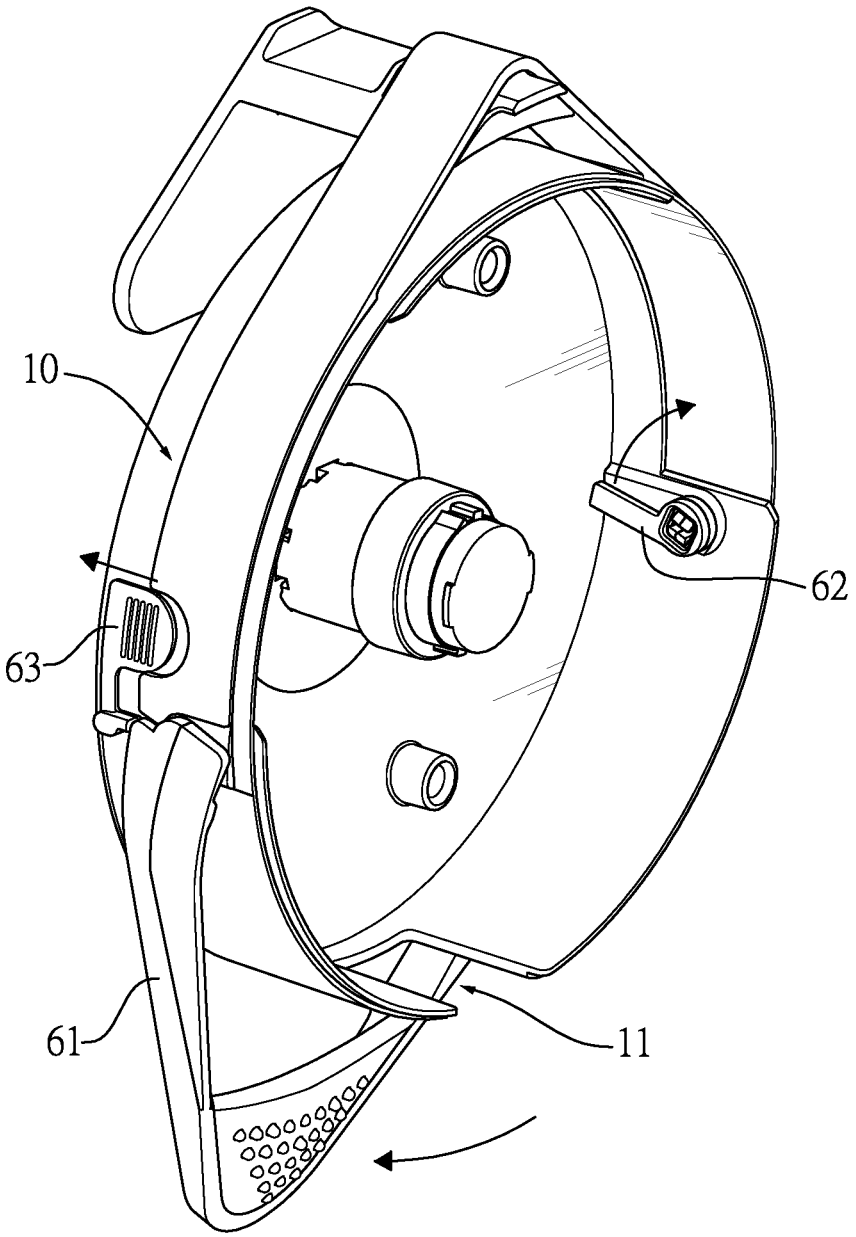

With further reference to FIGS. 6 and 7, the operation assembly 60 has a pushing lever 61, an actuating unit 62, and a lock 63.

The pushing lever 61 is located outside of the case 10 and is pivotally mounted in the case 10. Besides, in the first embodiment, the pushing lever 61 extends to below the dispensing hole 11 and is aligned to the dispensing hole 11. By this, a user is allowed to push the pushing lever 61 and catch the pills at the same time with one single hand, but the pushing lever 61 is not limited to extend to below the dispensing hole 11 in other embodiments.

The actuating unit 62 is located inside the case 10 and is fixed to the pushing lever 61. When the pushing lever 61 pivots relative to the case 10, the actuating unit 62 pushes the turning assembly 40 and then the turning assembly 40 turns the pill storage plate 30 to make one of the pill chambers 31 align to and communicate with the dispensing hole 11.

The lock 63 is moveably mounted on an outer surface of the case 10 and is capable of abutting the pushing lever 61 to fix the pushing lever 61, but the operation assembly 60 can also be implemented without the lock 63.

When the pushing lever 61 pivots relative to the case 10, the actuating unit 62 pushes and turns the first unit 41 to make the abutting segment 422 of the second unit 42 abut the gear segment 32 of the pill storage plate 30.

In addition, in another embodiment, the pill dispenser can be implemented without the plate base 20, and the pill storage plate 30 can also be implemented without the gear segment 32.

In that case, the pill storage plate 30 is pivotally mounted in the case 10 directly without the plate base 20. The pill chambers 31 are adapted to sequentially align to and communicate with the dispensing hole 11 directly without through the pill opening 23. The blocking segment 33 is adapted to directly align to and block the dispensing hole 11. The turning assembly 40 can be mounted on an inner surface of the case 10, can selectively abut any part of the pill storage plate 30 to turn the pill storage plate 30, and can abut any part of the pill storage plate 30 to stop the pill storage plate 30 after turning the pill storage plate 30. The spring sheet 50 can be mounted on the inner surface of the case 10, and abut any part of the pill storage plate 30 to position the pill storage plate 30.

Figure 12:
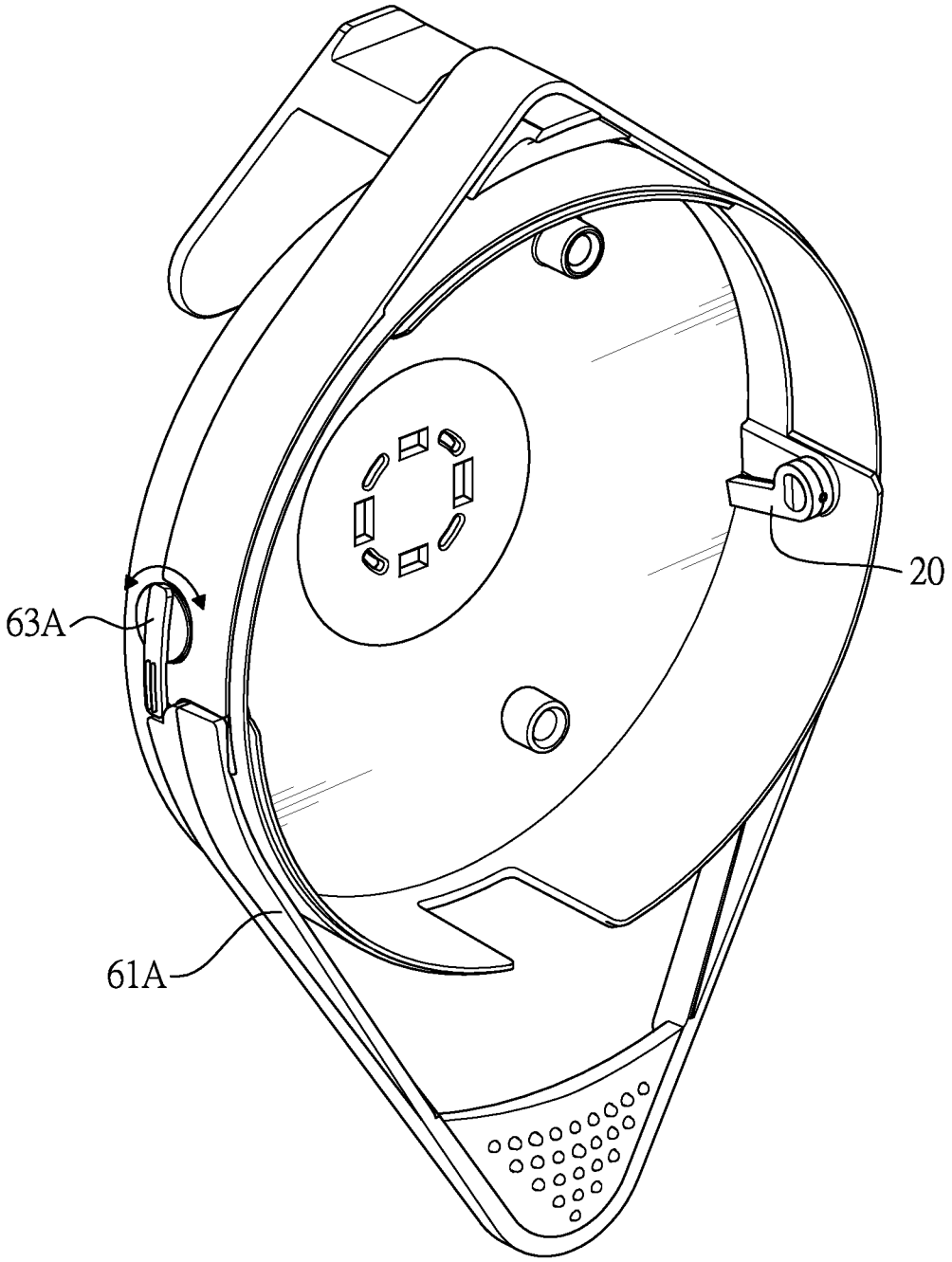
FIG. 12 is a perspective view of a second embodiment of the pill dispenser in accordance with the present invention, showing the case and the operation assembly.
Figure 13:
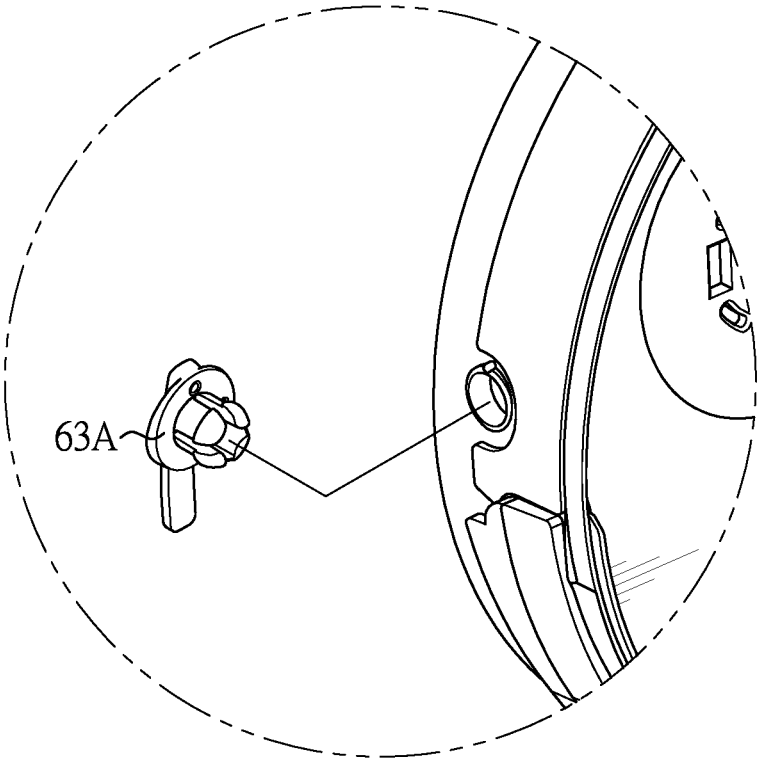
FIG. 13 is an exploded view of the second embodiment of the pill dispenser in FIG. 12, showing the lock and the case.
Figure 14:
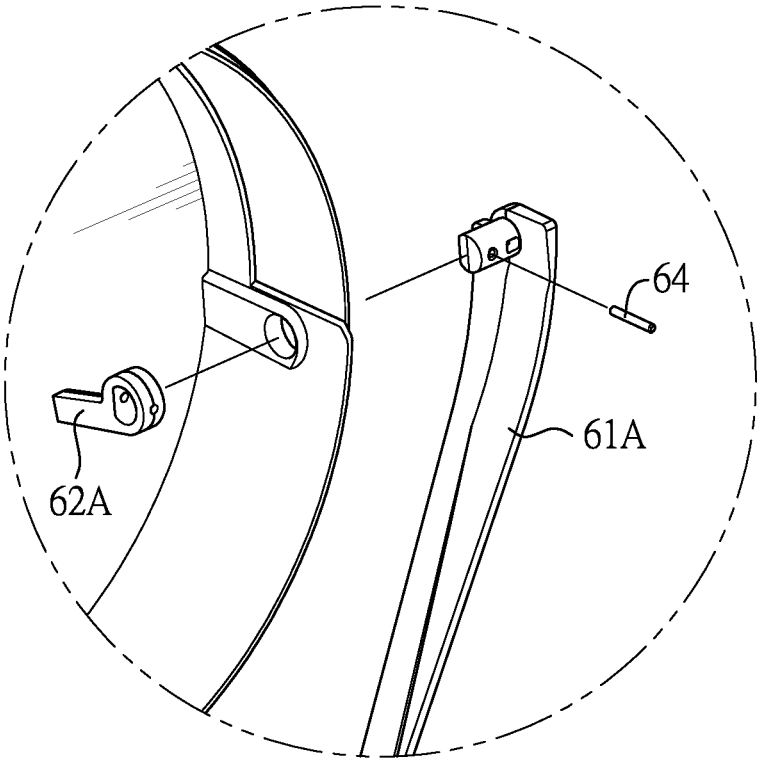
FIG. 14 is another exploded view of the second embodiment of the pill dispenser in FIG. 12, showing the pushing lever, the actuating unit, and the bolt.

With further reference to FIGS. 12 to 14, the structure of a second embodiment is basically the same as the first embodiment, but the differences are in the operation assembly. Specifically, in the second embodiment, the operation assembly has a pushing lever 61A, an actuating unit 62A, a lock 63A, and a bolt 64A. The bolt 64A is securely mounted through the pushing lever 61A and the actuating unit 62A to fix the pushing lever 61A and the actuating unit 62A. The lock 63A is pivotally mounted on the outer surface of the case and is capable of abutting the pushing lever 61A to fix the pushing lever 61A.

With further reference to FIGS. 2, 4, and 6, when the pill dispenser is in use, the user first opens the case 10 and distributes a certain dosage of pills into each pill chamber 31, and then aligns the blocking segment 33 to the pill opening 23 to prevent the pills dropping out of the case 10. At last, seal the case 10 and mount the pill dispenser at an obvious location on a wall for immediate access in case of emergency. Besides, the user can also use the lock 63 to lock the pushing lever 61 if needed.

With further reference to FIGS. 6 to 10, to retrieve the pills, the user first switches the lock 63 to unlock the pushing lever 61, and presses the pushing lever 61 to make the pushing lever 61 pivot relative to the case 10. At the time, the actuating unit 62 inside the case 10 pivots along with the pushing lever 61 and pushes the first unit 41 of the turning assembly 40. Since pushed, the first unit 41 pivots relative to the base board 21 and moves the second unit 42 to abut the gear segment 32 of the pill storage plate 30. As the actuating unit 62 continues pushing, the first unit 41 continues pivoting and the abutting segment 422 of the second unit 42 abuts one of the gear teeth of the gear segment 32. Then, the connecting segment 421 of the second unit 42 pivots relative to the first unit 41 and the abutting segment 422 pushes said one of the gear teeth of the gear segment 32 to turn the pill storage plate 30. After the pill storage plate 30 is turned, one of the pill chambers 31 is aligned to the pill opening 23 and the dispensing hole 11, and then the pill in the pill chamber 31 drops out from the dispensing hole 11 to the user's hand.

With the dispensing hole 11 formed on a bottom of the case 10 and the pill chambers 31 selectively aligned to and communicating with the dispensing hole 11 during the pivoting of the pill storage plate 30, the user is allowed to store pills in the pill chambers 31 and retrieve the pills from the dispensing hole 11 by turning the pill storage plate 30. With the pushing lever 61 pivotally mounted through the case 10 and the actuating unit 62 located inside the case 10 and fixed to the pushing lever 61, when the user turns the pushing lever 61, the actuating unit 62 can push the turning assembly 40 and then the turning assembly 40 can turn the pill storage plate 30. Therefore, the user can get the pills immediately by simply turning or pressing the pushing lever 61. Compared to a conventional bottle with a screw cap, turning or pressing the pushing lever 61 is much easier than holding tightly to unscrew the screw cap for a patient since turning or pressing the pushing lever 61 can be done by the whole arm while unscrewing the screw cap can only be done by fingers. Therefore, the pill dispenser in accordance with the present invention works efficiently and saves critical time and effort in cases of emergency.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pill dispenser comprising:

a case having a dispensing hole formed on a bottom of the case;

a pill storage plate pivotally mounted in the case and having multiple pill chambers annularly arranged around a pivot between the pill storage plate and the case; each one of the pill chambers selectively aligned to and communicating with the dispensing hole during the pivoting of the pill storage plate;

a turning assembly mounted in the case and being capable of turning the pill storage plate; and an operation assembly having a pushing lever located outside of the case and pivotally mounted in the case; the pushing lever being configured to be pushed by a user; and an actuating unit located inside the case and fixed to the pushing lever; wherein when the pushing lever is pushed to pivot relative to the case, the actuating unit pushes the turning assembly and then the turning assembly turns the pill storage plate to make one of the pill chambers align to and communicate with the dispensing hole, wherein the pill dispenser further has a plate base mounted in the case and having a base board having a connecting hole formed through a center of the base board;

a surrounding wall formed on a periphery of the base board, and having a pill opening formed through the surrounding wall and aligned to the dispensing hole of the case;

the pill storage plate is pivotally mounted in an inner side of the surrounding wall and has a gear segment rotatably mounted through the connecting hole;

the pill chambers of the pill storage plate are selectively aligned to and communicate with the dispensing hole through the pill opening; and the turning assembly is mounted on the base board, is located on a side, which is opposite to the pill storage plate, of the base board, and selectively abuts the gear segment to turn the pill storage plate.

2. The pill dispenser as claimed in claim 1, wherein the operation assembly further has a lock pivotally mounted on an outer surface of the case and being capable of abutting the pushing lever to fix the pushing lever.

3. The pill dispenser as claimed in claim 1, wherein the operation assembly further has a bolt securely mounted through the pushing lever and the actuating unit to fix the pushing lever and the actuating unit.

4. The pill dispenser as claimed in claim 1, wherein the pushing lever extends to below the dispensing hole and is aligned to the dispensing hole.

5. The pill dispenser as claimed in claim 1, wherein the operation assembly further has a lock moveably mounted on an outer surface of the case and being capable of abutting the pushing lever to fix the pushing lever.

6. The pill dispenser as claimed in claim 1, wherein the pill storage plate further has a blocking segment formed between any two adjacent ones of the pill chambers and adapted to align to and block the dispensing hole.

7. The pill dispenser as claimed in claim 1, wherein the turning assembly has a first unit pivotally mounted in the case; and a second unit pivotally mounted on the first unit; and when the pushing lever pivots relative to the case, the actuating unit pushes and turns the first unit to make the second unit abut the pill storage plate, and then the second unit pivots relative to the first unit and turns the pill storage plate.

8. The pill dispenser as claimed in claim 1, wherein the turning assembly has a first unit pivotally mounted on the base board;

a second unit pivotally mounted on the first unit; and an elastic unit connected between the first unit and the base board; the elastic unit configured to turn the first unit to move the second unit away from the gear segment of the pill storage plate; and when the pushing lever pivots relative to the case, the actuating unit pushes and turns the first unit to make the second unit abut the gear segment of the pill storage plate, and then the second unit pivots relative to the first unit and pushes one of gear teeth of the gear segment to turn the pill storage plate.

9. The pill dispenser as claimed in claim 7, wherein the second unit has a connecting segment being in a strip shape and pivotally mounted on the first unit; and an abutting segment being in a strip shape, formed on an end, which is opposite to the first unit, of the connecting segment, and forming an angle with the connecting segment; the angle being larger than 90 degrees; and when the pushing lever pivots relative to the case, the actuating unit pushes the first unit to turn the first unit and to make the abutting segment abut the pill storage plate, and then the connecting segment pivots relative to the first unit and the abutting segment turns the pill storage plate.

10. The pill dispenser as claimed in claim 8, wherein the second unit has a connecting segment being in a strip shape and pivotally mounted on the first unit; and an abutting segment being in a strip shape, formed on an end, which is opposite to the first unit, of the connecting segment, and forming an angle with the connecting segment; the angle being larger than 90 degrees; and when the pushing lever pivots relative to the case, the actuating unit pushes the first unit to turn the first unit and to make the abutting segment abut the gear segment of the pill storage plate, and then the connecting segment pivots relative to the first unit and the abutting segment pushes one of the gear teeth of the gear segment to turn the pill storage plate.

11. The pill dispenser as claimed in claim 7, wherein the first unit has a stopping segment; and after the second unit turns the pill storage plate, the stopping segment abuts the pill storage plate to stop the pill storage plate.

12. The pill dispenser as claimed in claim 10, wherein the first unit has a stopping segment; and after the second unit turns the pill storage plate, the stopping segment abuts one of the gear teeth of the gear segment of the pill storage plate to stop the pill storage plate.

13. The pill dispenser as claimed in claim 1, wherein the pill dispenser further has a spring sheet abutting the pill storage plate and positioning the pill storage plate; and when the pill storage plate is turned, the pill storage plate bends the spring sheet and turns relative to the spring sheet.

14. The pill dispenser as claimed in claim 13, wherein the spring sheet is in a V shape and has two block segments respectively formed on two ends of the V shape and abutting the pill storage plate.

15. The pill dispenser as claimed in claim 12, wherein the pill dispenser further has a spring sheet mounted on the base board of the plate base, located on the side, which is opposite to the pill storage plate, of the base board, abutting the gear segment of the pill storage plate, and positioning the pill storage plate; and when the pill storage plate is turned, the gear segment of the pill storage plate bends the spring sheet and turns relative to the spring sheet.

16. The pill dispenser as claimed in claim 15, wherein the spring sheet is in a V shape and has two block segments respectively formed on two ends of the V shape and engaging with the gear segment of the pill storage plate; and when the pill storage plate is turned, the gear segment bends the spring sheet and disengages from the two block segments.

17. The pill dispenser as claimed in claim 16, wherein the pill storage plate further has a blocking segment formed between any two adjacent ones of the pill chambers and adapted to align to and block the pill opening of the plate base.

18. The pill dispenser as claimed in claim 17, wherein the operation assembly further has a lock moveably mounted on an outer surface of the case and being capable of abutting the pushing lever to fix the pushing lever.

19. The pill dispenser as claimed in claim 18, wherein the pushing lever extends to below the dispensing hole, and is aligned to the dispensing hole.

* * * * *